US006321663B1

(12) United States Patent
Rogers

(10) Patent No.: US 6,321,663 B1
(45) Date of Patent: Nov. 27, 2001

(54) ADJUSTABLE DISPLAY SHELF SYSTEM

(76) Inventor: James A. Rogers, 2747 W. River Rd., Grand Island, NY (US) 14072

( * ) Notice: Subject to any disclaimer, the term of this patent is extended or adjusted under 35 U.S.C. 154(b) by 0 days.

(21) Appl. No.: 09/533,866

(22) Filed: Mar. 24, 2000

Related U.S. Application Data

(60) Provisional application No. 60/126,530, filed on Mar. 26, 1999.

(51) Int. Cl.[7] ..... A47B 57/00

(52) U.S. Cl. ..... 108/100; 211/195

(58) Field of Search ..... 108/91, 99, 100, 108/101; 211/149, 198, 199, 189, 195

(56) References Cited

U.S. PATENT DOCUMENTS

| | | | | |
|---|---|---|---|---|
| D. 332,857 | | 1/1993 | Cooper et al. . | |
| D. 341,508 | | 11/1993 | Cooper et al. . | |
| 1,322,435 | * | 11/1919 | Hauptman | 108/99 |
| 2,883,064 | * | 5/1959 | Mc Kenzie | 108/99 |
| 5,590,796 | * | 1/1997 | Herman | 108/99 |
| 5,730,068 | * | 3/1998 | Rioux, Jr. | 108/99 |
| 5,758,784 | * | 6/1998 | Chambers | 108/99 |
| 5,791,500 | | 8/1998 | Burke et al. . | |
| 5,823,368 | | 10/1998 | Burke et al. . | |
| 5,921,414 | | 7/1999 | Burke et al. . | |

FOREIGN PATENT DOCUMENTS

| | | | | |
|---|---|---|---|---|
| 10011-a | * | 5/1900 | (GB) | 108/99 |

* cited by examiner

*Primary Examiner*—Peter M. Cuomo
*Assistant Examiner*—Jerry A. Anderson
(74) *Attorney, Agent, or Firm*—Jaeckle Fleischmann & Mugel, LLP

(57) ABSTRACT

An adjustable inclined shelving system includes a rigid tubular horizontal base supporting an adjustable, articulated frame removably connected to the frame without the need for tools. The articulated frame includes front and rear legs. The front legs proximal to a customer are shorter than the rear legs distal from the customer. The articulated frame further includes a shelf support frame extending at an angle of incline between and removably attached to the front and rear legs for supporting a plurality of shelves. The legs are pivoted on the horizontal frame to change the system from a collapsed configuration, as for shipping or storage, to an erect configuration for display, and return. The system is afforded structural rigidity by removable diagonal braces extending between the legs and the horizontal frame. The front legs are pivoted from vertical to horizontal by unpinning of the braces to lower the shelving from an upright configuration to a kneeling configuration. The rear legs are telescopic and are extended or retracted to change the display angle. The shelving is removably attached to the shelf support frame and is configured in width and disposition of the individual shelves to optimize the display of a plurality of crates. Optionally, the legs may be further provided with transverse horizontal members for supporting detachable auxiliary shelves for displaying additional crates at the front and/or rear of the system.

11 Claims, 6 Drawing Sheets

ADJUSTABLE DISPLAY SHELF SYSTEM

CROSS-REFERENCE TO RELATED APPLICATIONS

This application claims the benefit of U.S. Provisional Application Serial No. 60/126,530, filed Mar. 26, 1999, now abandoned.

BACKGROUND OF THE INVENTION

The present invention relates to apparatus for displaying goods for sale, for example, crated goods such as supermarket produce; more particularly, to shelving apparatus having a plurality of shelves disposed on an inclined surface so that goods on higher shelves do not obscure viewing of goods on lower shelves; and most particularly to a system of shelves wherein the shelves are supported on an adjustable, articulated frame so that the display angle and height may be easily altered, and so that the system may be easily collapsed to facilitate storage or shipping, all manually and without the use of tools.

Inclined, or stepped, shelving for displaying various different lots of items together is well known, especially crated lots such as supermarket produce (citrus fruits, lettuce, tomatoes, etc.). Stepped shelving is a more efficient mode of display than a simple inclined surface, permitting more material to be displayed per length of incline.

It is generally desirable to be able to vary the angle of incline according to the changing display needs of the materials being displayed, to vary the distance of those materials from a customer standing in front of the display, and to vary the height of the materials. It is further desirable, for efficient use of display space, that shelving be formed to accommodate standard shipping crate sizes. In typical prior art displays varying these display parameters can be difficult or not possible, and can require special tools. Further, typical prior art displays are known to have a rigid frame, making storage and shipping of the display means cumbersome and consumptive of valuable storage space.

What is needed is a system of adjustable inclined shelving having a plurality of modular stepped shelves which provide a readily accessible display to a customer, wherein the angle of display, height of display, and distance of display from the customer may be easily changed without the need for any tools, and wherein an articulated supportive frame may be collapsed for storage and shipping.

It is a principal object of the invention to provide a system of improved adjustable inclined shelving wherein the angle and height of display may be changed without the need for tools.

It is a further object of the invention to provide a system of improved adjustable inclined shelving for crates wherein the depth of the shelves is optimal for displaying modular crates.

It is a still further object of the invention to provide a system of improved adjustable inclined shelving wherein the system may be collapsed for storage or shipping.

SUMMARY OF THE INVENTION

Briefly described, an adjustable inclined shelving system of the present invention has an adjustable, articulated frame comprising a rigid tubular horizontal frame portion and an articulated portion removably connected to the horizontal frame portion as by pins, preferably U-shaped, insertable and removable into matching holes in the respective frame members by hand without the need for tools. The adjustable frame includes front and rear generally vertical legs of unequal heights, the front legs proximal to a customer being shorter than the rear legs distal from the customer. The adjustable frame further includes a shelf support frame extending at an angle of incline between the front and rear legs for supporting a plurality of shelves. The shelf support frame is removably pinned to the legs. The legs may be pivoted on the horizontal frame to change the system from a collapsed configuration, as for shipping or storage, to an erected upright configuration or kneeling configuration for display, and return. In the upright and kneeling configurations, the system is afforded structural rigidity by one or more removable diagonal braces extending between the legs and the horizontal frame, which braces are held in place by removable pins. The front legs may be pivoted from vertical to horizontal by unpinning of the braces to lower the shelving to the kneeling configuration. The rear legs are telescopic and may be extended or retracted vertically to change the display angle as desired. The shelving is attached, preferably removably as by pins, to the shelf support frame and is configured in width and disposition of the individual shelves to optimize the display of a plurality of crates. Optionally, the legs may be further provided with transverse horizontal members for supporting detachable auxiliary shelves for displaying additional crates at the front and/or rear of the system.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DETAILED DESCRIPTION

Figure 3:
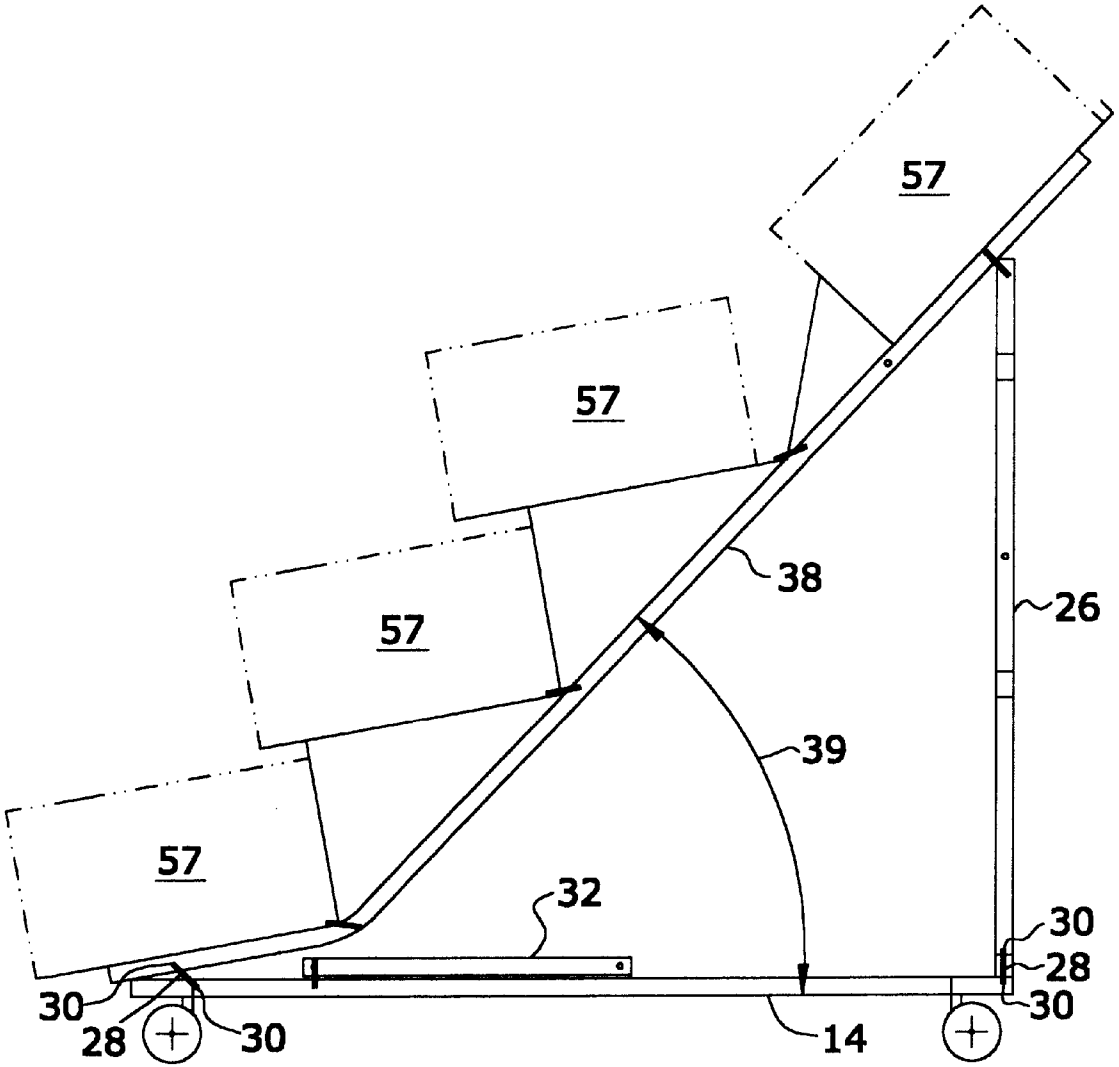
FIG. 3 is a side elevational view of the shelving system of the present invention in an erected knee configuration.
Figure 4:
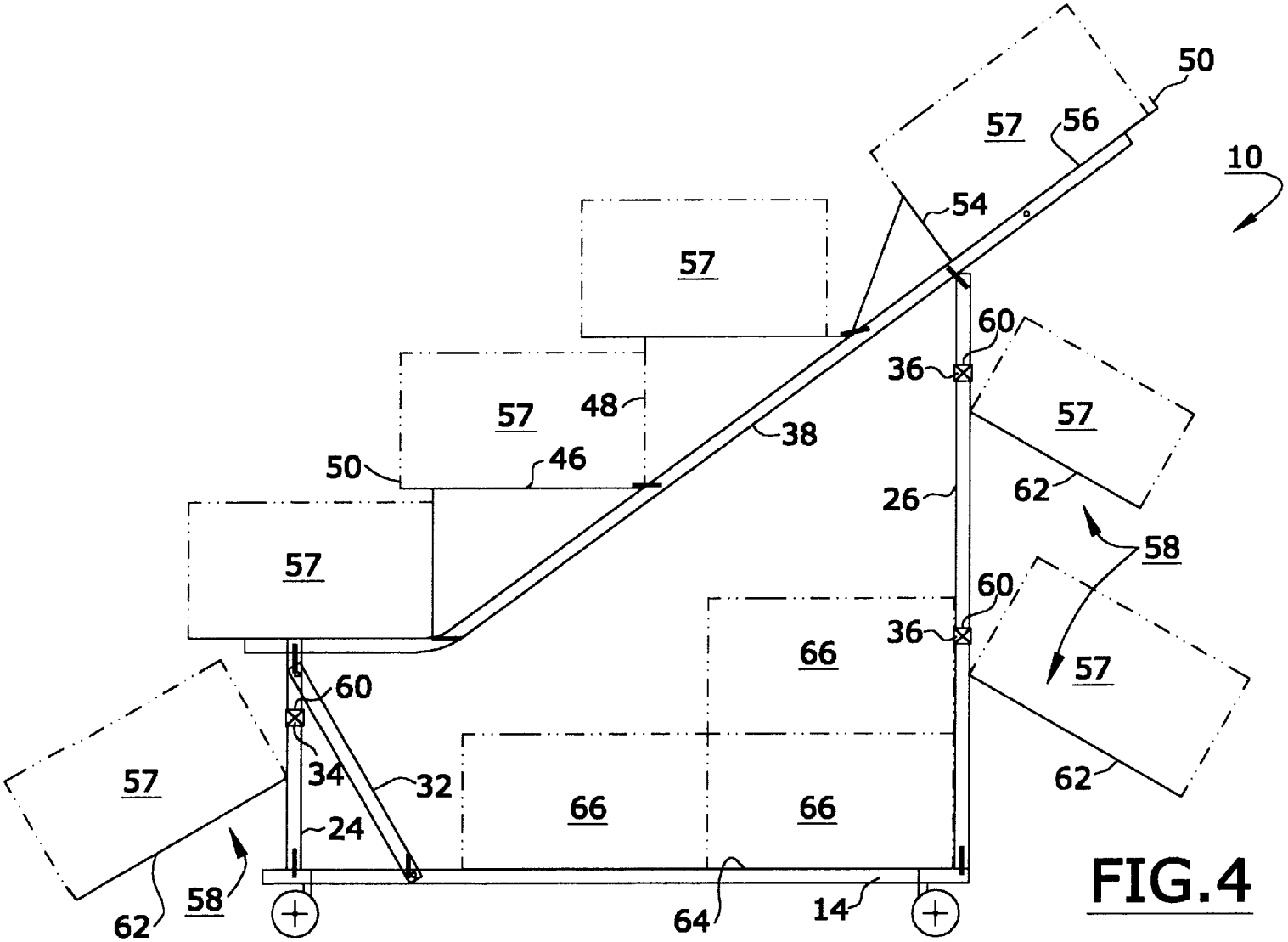
FIG. 4 is a side elevational view of the shelving system of the present invention showing of nal additional crate display positions and crate storage within the system frame.
Figure 5:
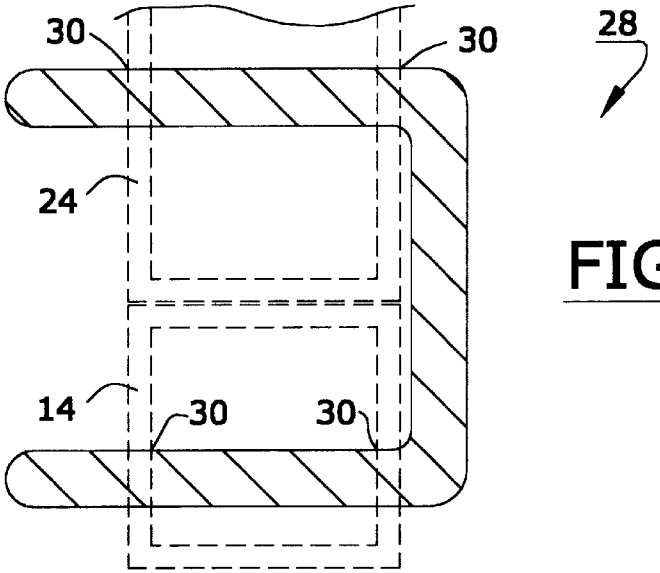
FIG. 5 is a cross-sectional view of a U-shaped pin for use in removably connecting various part of the system, for display or for storage, without the use of tools.

Referring to FIG. 1 through 8, an adjustable display shelf system 10 in accordance with the present invention has a horizontal, preferably rectangular frame 12 formed from, for example, metal tubing having a rectangular cross-sectional profile. Frame 12 includes side rails 14, front rail 16, and rear rail 18. Intermediate rails (not shown) extending between the side rails or between the front and rear rails may also be included as desired. Frame 12 may be provided with feet (not shown) and preferably is provided instead with castors 20, which may be swivelable or non-swivelable and may be lockable, at each corner 22. Front legs 24 and rear legs 26 are supported at their lower ends by frame 12 and extend upwards in a generally vertical direction. Front legs 24 and rear legs 26, formed of, for example, rectangular metal tubing, are particularly and removably connected to frame 12, preferably by connecting means which may be installed by hand and without the need for tools, for example by well-known spring clips, rings, or pins. A presently preferred connecting means is a generally U-shaped pin 28, as shown in FIG. 5, which may be inserted into matching holes 30 in frame 12 and legs 24, 26, as shown in FIGS. 1 through 5, for coupling the frame to the legs. Preferably, a plurality of such pins 28 are universal connectors used to form all the removable connections in the system.

Front legs 24 are diagonally supported for front-to-back rigidity by braces 32 (only one visible in the drawings) extending between legs 24 and frame 12. Front legs 24 may also include a cross-rail 34, as discussed further below. Rear legs 26 may also include one or more cross-rails 36, as discussed further below.

Rear legs 26 preferably are a predetermined amount longer than front legs 24 such that a shelf support frame 38 removably connected to the upper ends of legs 24, 26 is inclined toward the front of the system, this being the location from which a customer may most frequently view goods being displayed on the system.

Figure 1:
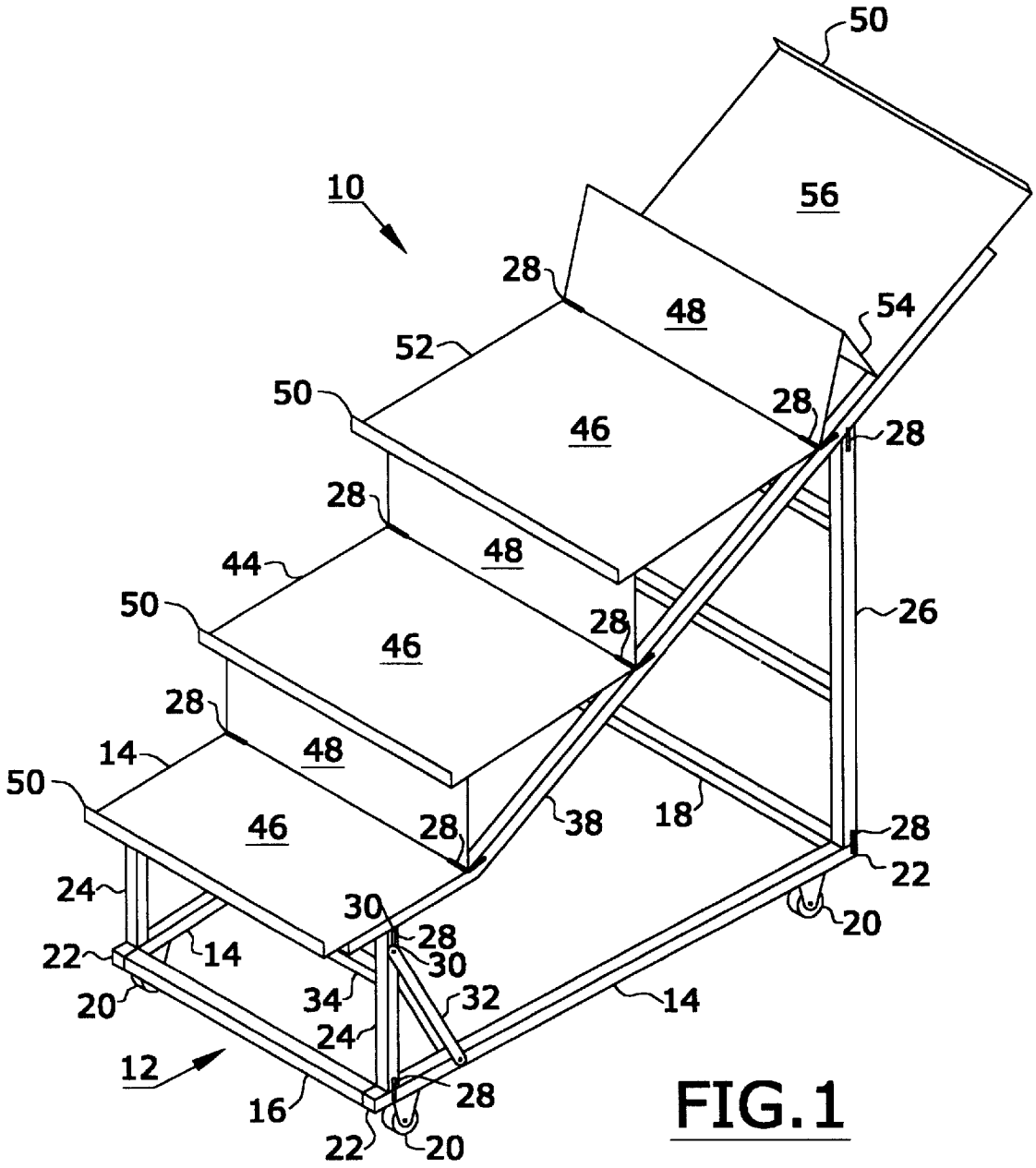
FIG. 1 is an isometric view of one embodiment of an adjustable shelving system in accordance with the invention.
Figure 2:
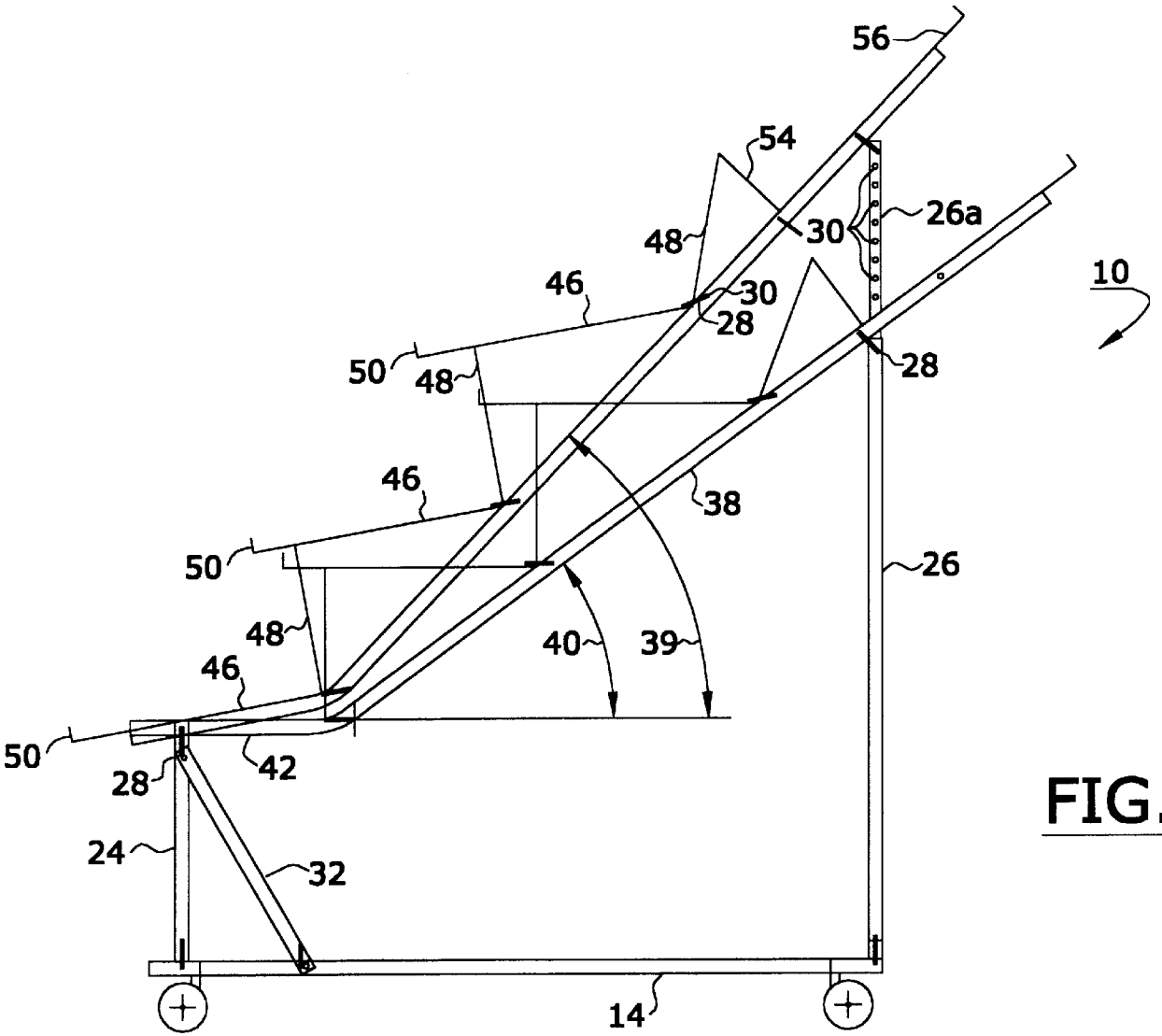
FIG. 2 is a side elevational view of the shelving system of FIG. 1 in an erected upright configuration, showing two different angles of display of the shelving.

Preferably, support frame 38 is bent near its lower end by a first angle 40 approximately equal to the lowest intended system angle of display, as shown in FIG. 2, such that the lower portion 42 of frame 38 is substantially horizontal. Frame 38 is connected to legs 24, 26 by pins 28, and preferably the connection to leg 24 also includes brace 32, as shown in FIGS. 1 and 2.

Rear legs 26 may be optionally provided with telescoping means for extending or retracting the legs to increase or decrease the angle of inclination of support frame 38. For example, frame 38 may be raised to a higher display angle 39, as shown in FIG. 2. Each leg 26, being formed of, for example, hollow rectangular tubing, include a telescoping member 26*a* extending from the upper end of leg 26, which member is perforated at intervals to permit its being secured as by pinning at any desired length of extension from leg 26.

Figure 7:
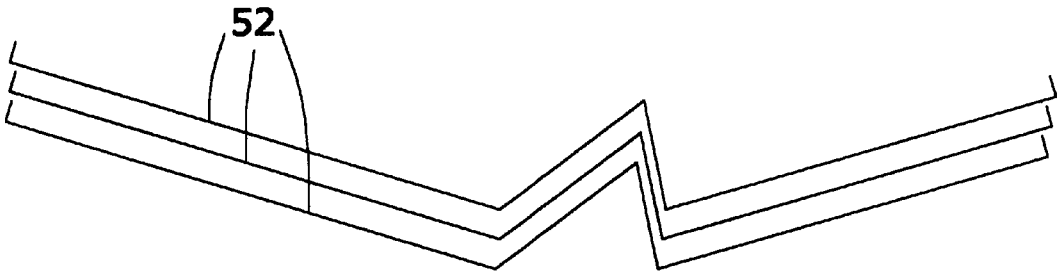
FIG. 7 is a side elevational view of a plurality of one type of shelf in accordance with the present invention, showing convenient nesting of the shelves for storage or shipping.
Figure 8:
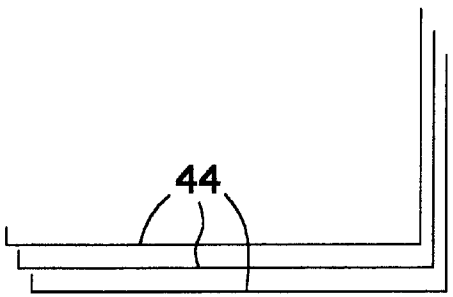
FIG. 8 is a view like that shown in FIG. 7, showing another type of shelf similarly nested.

Frame 38 supports display shelves, which may take a variety of forms. In embodiment 10, two exemplary forms of shelves are shown; other forms, as may be desired for specific display purposes, are within the scope of the invention. First shelves 44 are generally rectangular in cross-section, having a supporting bottom 46 and a back 48 and, preferably, a lip 50. Shelves 52 have a supporting bottom 46, back 48, and lip 50 and further have a supporting wall 54 attached to back 48 and a second bottom 56. Preferably, each of shelves 44 and 52 is formed separately, such as, for example, by stamping and/or folding sheet metal or by folding or extruding plastic polymer in known fashion, and is removably attached to support frame 38 by pins 28 as shown in FIGS. 1 through 4, similar to the way in which the frame components and legs are interconnected. Back 48 of the lowermost of shelves 44 supports the bottom 46 of the next-higher shelf 44, and back 48 of the highest shelf 44 supports the bottom 46 of shelf 52. Preferably, the shelves overlap only slightly, as shown in FIGS. 1 through 4, such that the interiors of open crates 57 of goods are readily visible on all shelves. Preferably, the front-to-back depth of bottoms 46, 56 is selected to hold a standard size crate snugly between the lip 50 and the back wall 48, 54. One such standard crate size is 24 inches long, 16 inches wide, and 8.5 inches deep. Preferably all of shelves 44 are identical such that they can be nested as shown in FIG. 8 for storage or shipping. A plurality of shelves 52 can also be similarly nested, as shown in FIG. 7.

Additional display shelf space at the front and rear of the system is optionally provided as shown in FIG. 4. One or more auxiliary shelves 58 is formed having a narrow U-shaped portion 60 for fitting between front legs 24 or rear legs 26 to hang over front cross-rail 34 or rear cross-rail 36 and a wider bottom and lip portion 62 for engaging the outer surface of the legs to hold the shelf in place.

If desired, a pan 64 may be formed to fit across the side rails 14 to support stored crates 66 within the interior of the erected frame, as shown in FIG. 4.

System 10 is conveniently erected in either an upright or kneeling configuration. In the upright configuration, as shown in FIGS. 1, 2, and 4, shelf support frame 38 is supported by front legs 24. Alternatively, braces 32 and front legs 24 are disconnected from frame 38 and folded onto side rail 14, as shown in FIG. 3 (or removed entirely), permitting frame 38 to be connected directly to side rail 14 in the kneeling configuration.

Figure 6:
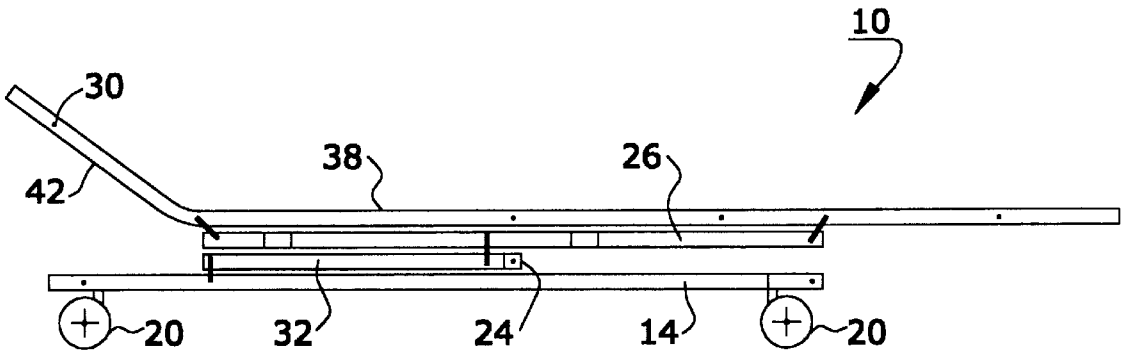
FIG. 6 is a side elevational view of the system shown in FIGS. 1–4, showing the system in a lapsed configuration for storage or shipping.

The system frame is conveniently collapsed for storage or shipment, one possible collapsed configuration being shown in FIG. 6. Obviously, numerous other collapsed configurations and/or disassemblies will occur to those skilled in the art, and all such configurations are within the scope of the invention.

From the foregoing description, it will be apparent that there has been provided an improved adjustable display shelf system, wherein a collapsible frame may be set up in a range of display angles and may be folded for storage or shipping without the use of tools. Variations and modifications of the herein described shelf system, in accordance with the invention, will undoubtedly suggest themselves to those skilled in this art. Accordingly, the foregoing description should be taken as illustrative and not in a limiting sense.

What is claimed is:

1. An adjustable display shelf system, comprising:

a) an articulated frame having joints which are connectable by connecting means to cause said frame to be erected; and b) a plurality of shelves removably attached to said erected frame, said erected frame presenting said shelves on an incline;

wherein said articulated frame includes, a generally rectangular horizontal frame portion, front legs and rear legs removably attached to said horizontal frame, and a shelf support frame portion removably attached to said front and rear legs for supporting said plurality of shelves, wherein said front and rear legs extend generally upwards vertically from said horizontal frame, and said rear legs are longer than said front legs to position said shelf support frame to provide said incline.

2. A shelf system in accordance with claim 1, wherein said plurality of shelves is arranged stepwise in ascension along said incline.

3. A shelf system in accordance with claim 1, wherein connecting said joints can be performed manually and unaided by tools.

4. A shelf system in accordance with claim 3, wherein said connecting means includes pins for insertion into holes in said frame.

5. A shelf system in accordance with claim 4, wherein said pins includes a generally U-shaped pin.

6. A shelf system in accordance with claim 1, further comprising a plurality of castors for supporting said frame.

7. A shelf system in accordance with claim 1, further comprising means for mounting at least one auxiliary shelf on said legs.

8. A shelf system in accordance with claim 1, further comprising means for storing goods within said erected frame.

9. A shelf system in accordance with claim 1, wherein said frame further includes at least one diagonal brace removably disposed between said horizontal frame and one of said legs.

10. An adjustable display shelf system, comprising:

a) an articulated frame having joints which are connectable by connecting means to cause said frame to be erected; and b) a plurality of shelves removably attached to said erected frame, said erected frame presenting said shelves on an incline;

wherein said articulated frame includes, a generally rectangular horizontal frame portion;

front legs and rear legs removably attached to said horizontal frame; and a shelf support frame portion removably attached to said front and rear legs for supporting said plurality of shelves, wherein said front and rear legs extend generally upwards vertically from said horizontal frame, and said rear legs are longer than said front legs to position said shelf support frame to provide said incline, wherein each of said rear legs comprises, a first hollow member; and a second member slidably disposed within said first member, said second member being telescopically extendable from and retractable into an end of said first member to lengthen and shorten, respectively, said rear leg to pivot said shelf support about said front legs to change the angle of said incline.

11. An adjustable display shelf system, comprising:

a) an articulated frame having joints which are connectable by connecting means to cause said frame to be erected; and b) a plurality of shelves removably attached to said erected frame, said erected frame presenting said shelves on an incline;

wherein said articulated frame includes, a generally rectangular horizontal frame;

rear legs removably attached to said horizontal frame;

a shelf support frame removably attached to said horizontal frame and said rear legs for supporting said plurality of shelves; and front legs which may be pivoted out of the way to permit attachment of said shelf support directly to said horizontal frame.

* * * * *